United States Patent [19]

Kinto

[11] 4,444,558

[45] Apr. 24, 1984

[54] SYSTEM FOR HEATING BROADWISE-END PORTIONS OF METAL MATERIAL

[75] Inventor: Koichiro Kinto, Mie, Japan

[73] Assignee: Daidotokushuko Kabushikikaisha, Japan

[21] Appl. No.: 426,502

[22] Filed: Sep. 29, 1982

[51] Int. Cl.[3] ..... F27B 9/22; F27B 14/14

[52] U.S. Cl. ..... 432/225; 432/146; 432/175; 432/196

[58] Field of Search ..... 432/143, 144, 146, 147, 432/148, 161, 175, 194, 196, 225, 226

[56] References Cited

U.S. PATENT DOCUMENTS

| | | | |
|---|---|---|---|
| 3,147,960 | 9/1964 | Ruff | 432/175 |
| 3,280,428 | 10/1966 | Watts, Jr. | 432/226 |
| 3,985,497 | 10/1976 | Fellnor et al. | 432/146 |
| 4,125,364 | 11/1978 | Stephens | 432/196 |
| 4,168,950 | 9/1979 | Seemann et al. | 432/175 |
| 4,359,209 | 11/1982 | Johns | 432/225 |

*Primary Examiner*—Henry C. Yuen

*Attorney, Agent, or Firm*—William A. Drucker

[57] ABSTRACT

System for heating the broadwise-end portions of a metal plate in conveyance. The system includes a pair of heater blocks spaced apart from each other with the conveyance line for the material located therebetween. The heater blocks each have a space to receive one of the broadwise-end portions of the material. When the material is conveyed through the system, the broadwise-end portions of the material each are allowed to pass through the space of one of the heater blocks so that they are heated by burners of the heater blocks blowing hot combustion gases against the broadwise-end surfaces of the material.

7 Claims, 12 Drawing Figures

SYSTEM FOR HEATING BROADWISE-END PORTIONS OF METAL MATERIAL

BACKGROUND OF THE INVENTION

1. Field of the Invention

This invention relates to a system for heating metal plate such as slab or billet discharged from such a device as a continuous casting apparatus or heating furnace, and to be conveyed to a hot rolling device in a position between the two devices, and more particularly relates to a system for heating the portions of a metal material which may be cooled to lower temperatures than the other portions thereof during conveyance thereof between the two devices, namely, both broadwise-end portions of the material, while the material is in conveyance.

2. Description of the Prior Art

When a metal material discharged from such a device as a continuous casting apparatus is conveyed to a hot rolling device, the material may be cooled in some of its parts, and more particularly both broadwise-end portions of the material may be cooled to lower temperatures than its other portions so that the material is not in the suitable condition for the hot rolling thereof when it has reached the device therefor. Heretofore an attempt to solve this problem has been made by blowing hot combustion gases to the broadwise-end surfaces of the material from burners located with the conveyance line of material extending therebetween when the material is conveyed between the two devices; however, such a method has a tendency to result in some portions of the upper or lower surface of the broadwise-end portions of the material being left under lowered temperatures. In addition, such a method has involed a low rate of heat transfer so that a great amount of fuel is required for effective heating of the material.

SUMMARY OF THE INVENTION

It is an object of the invention to provide a system for heating the broadwise-end surfaces of a metal material heated in and discharged from a preceding device and to be conveyed to a rolling device so that no substantial difference is made between the temperature of the main or central portion of the material and those of the broadwise-end surfaces thereof during conveyance, thus allowing the material to reach the rolling device with a more suitable distribution of temperatures than those obtained in the prior art given to the material.

Another object of the invention is to provide a system for heating not only the broadwise-end surfaces of a metal material, but also both upper and lower surfaces of the broadwise-end portions thereof so that the material may have a still more suitable distribution of temperatures for the rolling thereof.

A still another object of the invention is to provide a system for heating the upper and lower surfaces of the broadwise-end portions of a metal material as well as the broadwise-end surfaces thereof which is characterized in that the gases used for heating the broadwise-end surfaces are also used for the heating of the upper and lower surfaces of the broadwise-end portions, thus providing a higher thermal efficiency.

That is, according to the invention, a pair of horizontal partition means are opposed to the upper surface of one of the broadwise-end portions of the material in conveyance and to the lower surface of the same portion, respectively, so that a portion of the gases used for heating the broadwise-end surface is allowed to flow along the upper surface of the end portion, while the other portion thereof is allowed to flow along the lower surface of the end portion of the material; both upper and lower surfaces of the end portion are thus heated.

Yet another object of the invention is to provide a system for heating the upper and lower surfaces of the broadwise-end portions of a metal material as well as the broadwise-end surfaces thereof with a higher thermal efficiency by using the gases used to heat the broadwise-end surfaces thereof.

That is, according to the invetion, when the gases used to heat the broadwise-end surfaces of the material are guided to flow along the upper or lower surface of the material by the foregoing partition means, they also increase the temperature of the guide or partition means so that they radiate heat against the upper or lower surface of the material (i.e., of the broadwise-end portion thereof); that is, the upper and lower surfaces of the broadwise-end portion thereof are heated not only by the gases flowing along them, but also by the guide means giving a supply of radiant heat.

Other objects and advantages of the invention will become apparent during the following discussion of the accompanying drawings.

DESCRIPTION OF THE PREFERRED EMBODIMENTS

Figure 1:
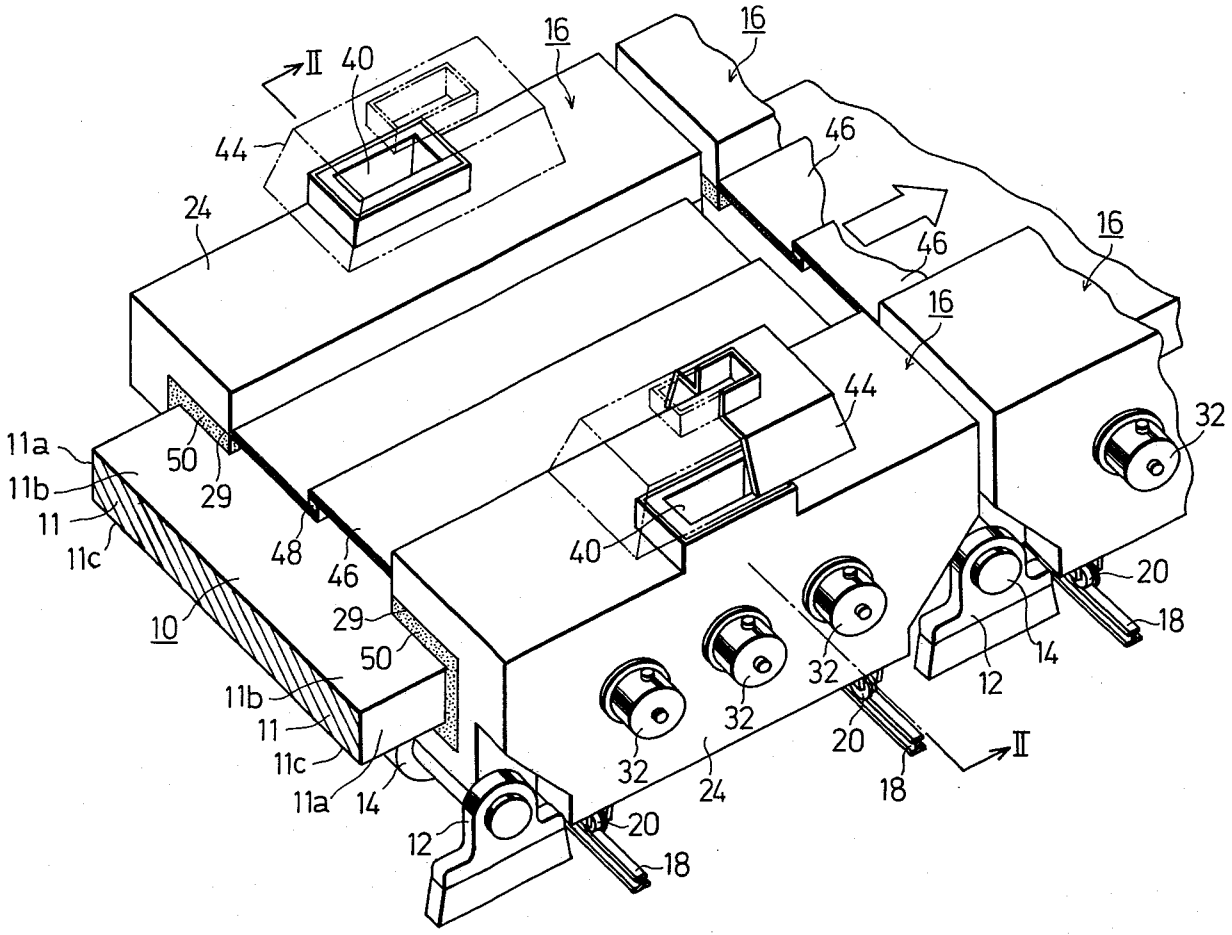
FIG. 1 is a perspective view of a system for heating the broadwise-end portions of a metal material in accordance with the invention.
Figure 2:
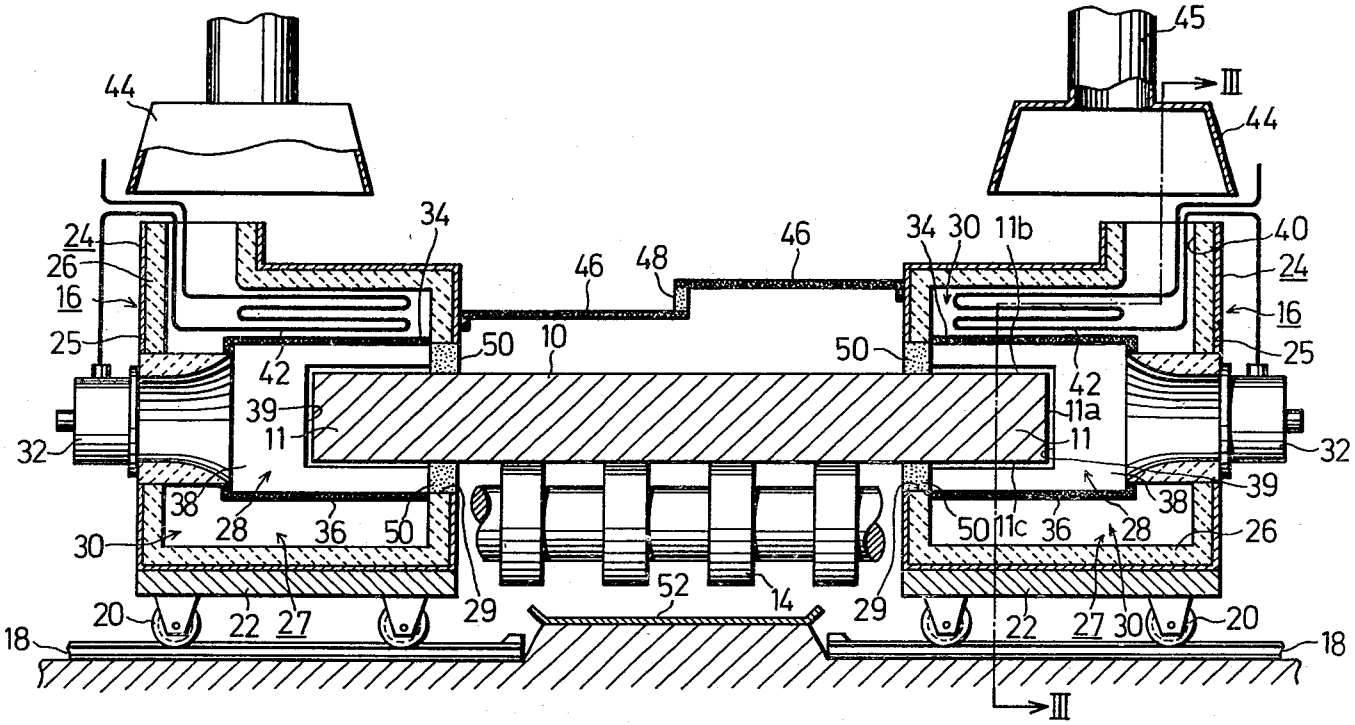
FIG. 2 is a cross section of the system of FIG. 1 taken on the line II—II.
Figure 3:
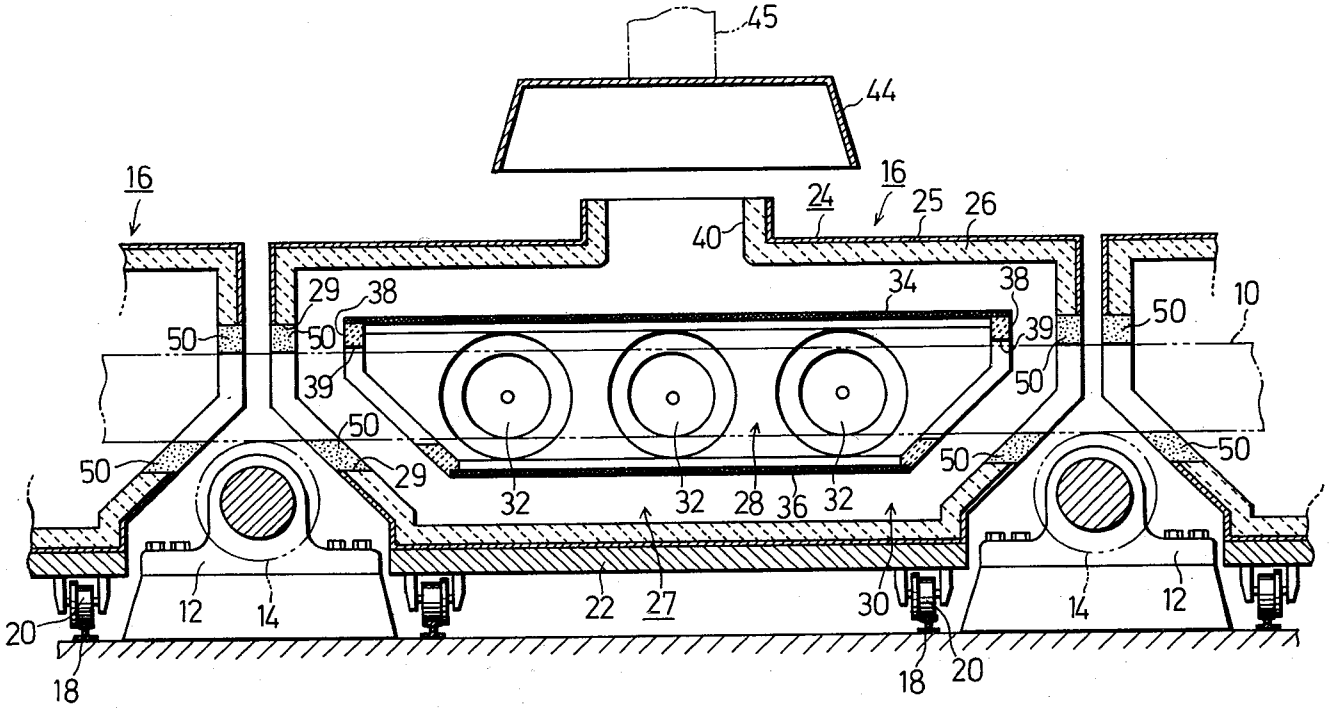
FIG. 3 is a cross section taken on the line III—III of FIG. 2.

Referring to FIG. 1, a device for heating the broadwise-end portions of a metal plate is located on a metal-material-conveyance line between a cutting device (well known in the art and not shown) and a hot rolling device (well known in the art and not shown) which are installed subsequently to a continuous casting system. That is, a metal plate 10 (slab in the description that will follow) cast in the continuous casting system is conveyed, in the direction indicated by an arrow, by and on rollers 14 each of which is supported by bearings 12 at its both ends and is operated by a suitable source of motive power (not shown). The metal material 10, however, may be conveyed by any other suitable means such as a truck instead of the rollers 14. A pair of heater blocks 16 are provided along the material-conveyance line and with the same line located therebetween. The heater blocks 16 are adapted to move toward or away from each other. Preferably a number of such pairs of blocks 16 are located along the conveyance line. As clearly shown in FIG. 2, each heater block 16 comprises a base 22 and a casing 24 connected to the top of the base 22. The base 22 of the heater block 16 has wheels 20 which allow the base 22 or whole heater block 16 to move on rails 18 disposed at right angles to the material conveyance line. The casing 24 of the heater block 16 comprises a shell 25 of suitably-reinforced steel and a lining 26 attached to the inner surface of the shell 25. The casing 24 also includes an inner space 27 which allows one 11 of the broadwise-end portions of the material 10 to pass through the heater block 16, as well as an opening 29 which stretches over the wall of the casing facing the material-conveyance line, its front wall, and its rear wall so as to allow the broadwise ends of the material 10 to pass through the inner space 27. A pair of heat-resistant sealers 50 are vertically spaced apart from each other in the portion of the anugular opening 29 facing the material-conveyance line so that no space is left between the foregoing inner opening and the metal material 10 in conveyance. The sealers 50 each are made of flexible material such as asbestos or ceramic fiber. A plurality of burners 32 (three burners in the embodiment of the drawings) are connected to the wall of the casing 24 opposite to its wall facing the material-conveyance line. The burners 32 each are adapted to burn gas or oil with the help of air so that they produce and supply hot combustion gases into the space 27 in the casing 24, thus blowing the gases against the material 10 in conveyance, and more particularly against one of the sides 11*a* of the material 10 extending along the material-conveyance line. A pair of walls 34 and 36 of air-permeable solid matter are vertically spaced apart from each other in the space 27 of the casing 24 so that one 34 of the walls faces the upper surface 11*b* of the material 10, while the other wall 36 faces the lower surface 11*c* thereof. The two walls 34 and 36 both are in substantially-horizontal positions. The upper wall 34 extends to one of the upper edges of the inner opening (of the casing 24) at one end thereof and to a position directly above the inner or gas-blowing end of the burner 32 at its other end, while the lower wall 36 extends to one of the lower edges of the inner opening (of the casing 24) at one end thereof and to a position directly below the gas-blowing end of the burner 32 at its other end. The air-permeable solid matter as the material of each wall is a heat-resistant material such as metal or ceramics of a suitable thickness formed into a honeycomb-like shape, fibrous, or porous structure; it may be considered that such an air-permeable structure is equivalent, in construction, to a number of wires or particles of very small size, so that the solid matter has a very large area of occupied surface (i.e., one that is not vacant). Therefore, when the hot combustion gases are allowed to pass the solid matter (as described hereinafter), a heat exchange is made in a great rate so that the solid matter is heated effectively. And since a solid matter has a much greater capacity for radiating heat than gas, the air-permeable solid matter discharges a supply of greater amount of heat to the upstream side of the combustion gases. In the embodiment herein, each air-permeable wall is constructed of six heat-resistant wire nets (of 1.0 mm. in wire diameter and of 16 meshes) connected to one another in layers to a thickness of approximately 12 mm. As shown in FIG. 3, the forward and backward ends of the upper wall 34 are connected to those of the lower wall 36, respectively, by means of heat-resistant, airtight walls 38 which each are provided with an opening 39 to allow the material 10 to pass between the two walls 34 and 36. The portion of the space 27 surrounded by the vertically opposite walls 34 and 36 and the horizontally opposite walls 38 and 38 provides a material-heating space 28, while the remaining portion of the space 27 outside the heating space 28 provides a flow passage 30 for the gases used for heating the material 10. A duct 40 for discharging the used gases is connected to the top of the casing 24. The discharge duct 40 is opened at its upper end, and an exhaust hood 44 is located above the opening of the duct 40. The exhaust hood 44 is so dimensioned that it is opened above the travelling cource of the duct 40 when the heating block 16 is moved on the rails 18. In the portion of the flow passage 30 located on the upper side of the upper wall 34 is provided a heat exchanger 42 for preheating the air to be supplied to the burner 32, which exchanger 42 has an air-supply pipe connected to the burners 32 through the duct 40.

A pair of cover plates 46 are horizontally connected to and between the opposite heating blocks 16 at different heights, and project inward or toward each other so as to overlap each other at their inward ends which are connected to each other by means of a flexible connector 48. The cover plates 46 are also supported by suitable means (not shown) so that the plates 46 are spaced apart from the marial 10 in conveyance. The cover plates 46 each are made of heat-resistant, heat-insulating materials for the maximum prevention of the escape of thermal energy from the material 10. It may be more preferable, however, to employ the foregoing kind of air-permeable solid matter as the material of the cover plates 46 because, in such a case, a large portion of the heat radiated from the material 10 and transferred to the plates 46 is allowed to return to the material 10 by the foregoing property characteristic of the solid matter. Also, the connector 48 is of a heat-resistant material such as asbestos or ceramic fiber to prevent heat from escaping from the space covered by the plates 46. In addition, a reflecting plate 52 of such a material as stainless steel is located between the opposite heating blocks 16 and below the material-conveyance line. The function of the reflecting plate 52 is to prevent the thermal energy given to the material 10 escaping from the lower surface thereof.

The foregoing heating system is operated as follows: For a start, the opposite heating blocks 16 are moved, on the rails 18, toward or away from each other in accordance with the breadth of the material, i.e., so that the broadwise-end portions 11 of the material are allowed to pass through the heating chambers 28 of the blocks 16. Then, fuel and air are supplied to the burners 32, and the burners are operated to produce hot combustion gases. The rollers 14 are rotated to start conveying the material. The material is thus conveyed along the conveyance line, with its broadwise-end portions 11 passing through the heating chambers 28 of the blocks 16. In each heating block 16, the hot combustion gases supplied from the burners 32 into the heating chamber 28 are first blown against one of the lengthwise sides 11*a* of the material to heat the same side 11*a*. Then the gases are guided by the top 34 and bottom 36 of the chamber 28 so that a portion of the gases flows along the upper surface 11*b* of the material-end portion 11, while the other portion thereof flows along the lower surface 11*c* of the end portion 11, and the two streams of the gases come from the chamber 28 through different portions of the top 34 and bottom 36 of the end portion 11, respectively, so that the gases are discharged into the flow passage 30. When flowing between the material-end portion 11 and the top 34 and bottom 36 of the chamber 28, the gases heat not only the upper and lower surfaces 11*b* and 11*c* of the material-end portion 11, but also the top 34 and bottom 36 of the chamber 28, so that the top 34 and bottom 36 radiate the heat against the upper and lower surfaces 11*b* and 11*c* of the material-end portion 11, respectively. In addition, when passing through the chamber top 34 and bottom 36 to come into the flow passage 30, the gases further give a great amount of heat to them 34 and 36 so that they are further heated, thus radiating an additional amount of heat against the upper and lower surfaces 11*b* and 11*c* of the material-end portion 11. Incidentally, the following advantage is to be noted: If the gases supplied from the burners 32 contain fuel which has not undergone the combustion, such fuel may be burned when passing through the top 34 or bottom 36 of the chamber 28, because both top 34 and bottom 36 of the chamber 28 are heated to very high temperatures as mentioned above; this advantage contributes to both increased purification of the used gases and increased efficiency of combustion of the gases.

After coming from the heating chamber 28 into the flow passage 30, the gases heat the heat exchanger 42, flow out from the duct 40, and pass through the exhaust hood 44 and a duct 45 connected to the hood 44 so that they are discharged into a stack, the outside air, an exhaust-gas treatment system, or the like.

In the foregoing treatment, the portion of the metal material 10 not passing through the heater blocks 16 is prevented from being reduced in its temperature by the cover plates 46 and reflecting plate 52 keeping the heat of the material 10 escaping from the upper and lower surfaces of the material.

When the broadwise-end portions 11 of the material 10 has been heated in the foregoing manner, the material has substantially-equal high temperatures in its entire cross section so that the material is in the suitable condition for the hot rolling thereof. The material is then conveyed to the hot rolling device in this condition.

Figure 4:
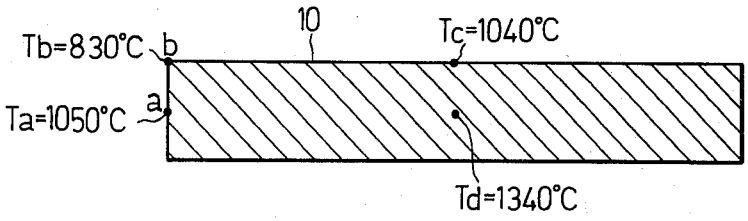
FIG. 4 illustrates the distribution of temperature of a metal material during conveyance from a continuous casting system to a hot rolling device.

The foregoing uniform heating of the entire material may be illustrated as follows: If a metal material with a thickness of 200 mm. and a breadth of 1,600 mm. is conveyed from the continuous casting system to the hot rolling device without being heat-treated in the foregoing manner, the slab has different temperatures in different portions as indicated in FIG. 4 when reaching the hot rolling device; that is, the temperatures of a point a of a lengthwise side of the material at the center of its thickness, of its edge b, and of the point c of its upper surface at the center of its breadth (i.e., temperatures Ta, Tb, and Tc) become smaller than that Td of its center of both thickness and breadth. Therefore, such a slab is not in the condition suitable for the hot rolling thereof. However, if the slab is treated by the foregoing heating system, the different portions of the entire surface thereof may have temperatures which are approximately the same as that of the center of both thickness and breadth thereof so that the slab is brought into the suitable condition for the hot rolling thereof.

Figure 5:
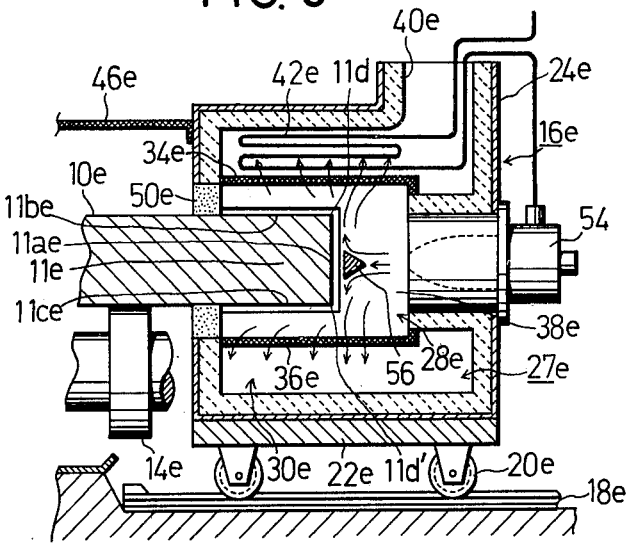
FIG. 5 is a sectional view of a heater block for the system of FIG. 1 which is different from that of FIG. 2 in that a means for separating hot combustion gases into two streams is provided.

For the heating system herein, such a heater block 16*e* as shown in FIG. 5 may be employed instead of the preceding one. The heater block 16*e* includes a jet burner 54 which is adapted to beam forth hot combustion gases in a converging manner. In a heating chamber 28*e* is provided a separator means 56 of heat-resistant material which is located between the vertical middle point of one of the lengthwise sides 11*ae* of a material 10*e* (in conveyance) and the burner 54. The separator means 56 is connected to both top 34*e* and bottom 36*e* of the chamber 28*e* or to a airtight wall 38*e* by a suitable support means (not shown).

In such a construction, hot combustion gases are beamed forth from the burner 54, and a portion of the gases is caused to flow upward by the separator means 56, while the other portion thereof is caused to flow downward thereby; that is, the two separated streams of the gases are moved toward the portions of the metal material 10*e* which require to be heated by the greatest degree, namely, toward the upper and lower edges 11*d* and 11*d'* of the material 10*e*, so that the two edges are prevented from lowering in their temperatures compared with the other portions of the material. After thus heating each edge, each stream of the gases flows along the upper surface 11*be* or lower surface 11*ce* of the broadwise-end portion 11*e* of the material and comes from the chamber 28*e* while a certain portion thereof flows directly to the top 34*e* or bottom 36*e* of the chamber 28*e* to come therefrom.

In the foregoing second construction and those that will follow hereinafter, portions or sections identical or similar to those of the first construction in function are designated by the same numerals as those of the first construction and the alphabetical letters e to k attached thereto.

Figure 6:
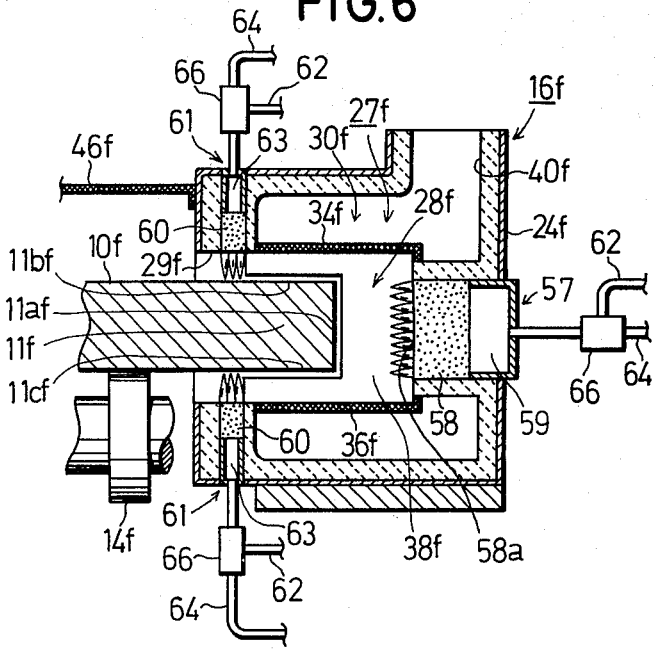
FIG. 6 is a sectional view of a heater block for the system of FIG. 1 which is different from the preceding ones in that burning walls are employed as burners and sealer means.

A still another construction of heater block is illustrated in FIG. 6. In this construction is employed a heater block 16*f* including a burner or burning wall 57. The burner 57 comprises a wall 58 of porous material such as porous brick and a chamber 59 for supplying a mixture of fuel gas and air through the wall 58.

In the foregoing construction, fuel gas and air are supplied under pressure through pipes 62 and 64 (preferably extending from the heat exchanger) and into a mixer 66 which produces a gas mixture. The gas mixture is supplied into the chamber 59 of the burner 57, and then caused to infiltrate through the wall 58 thereof so that the gases pass through a number of small openings of the wall 58 to blow out from the different portions of the entire inner surface 58*a* of the wall 58. And when blowing out therefrom, the gases are burned. Therefore, flames are very uniformly produced from the entire inner surface 58*a* of the wall 58.

An inner opening 29*f* of the heater block 16*f* is provided with a pair of sealer means 61 which are not the same as heat-resistant sealers 50 of the first construction, but of the same kind as the burner 57. Numerals 60 and 63 designate a wall of porous material and a chamber for supplying a gas mixture through the wall 60, respectively.

Figure 7:
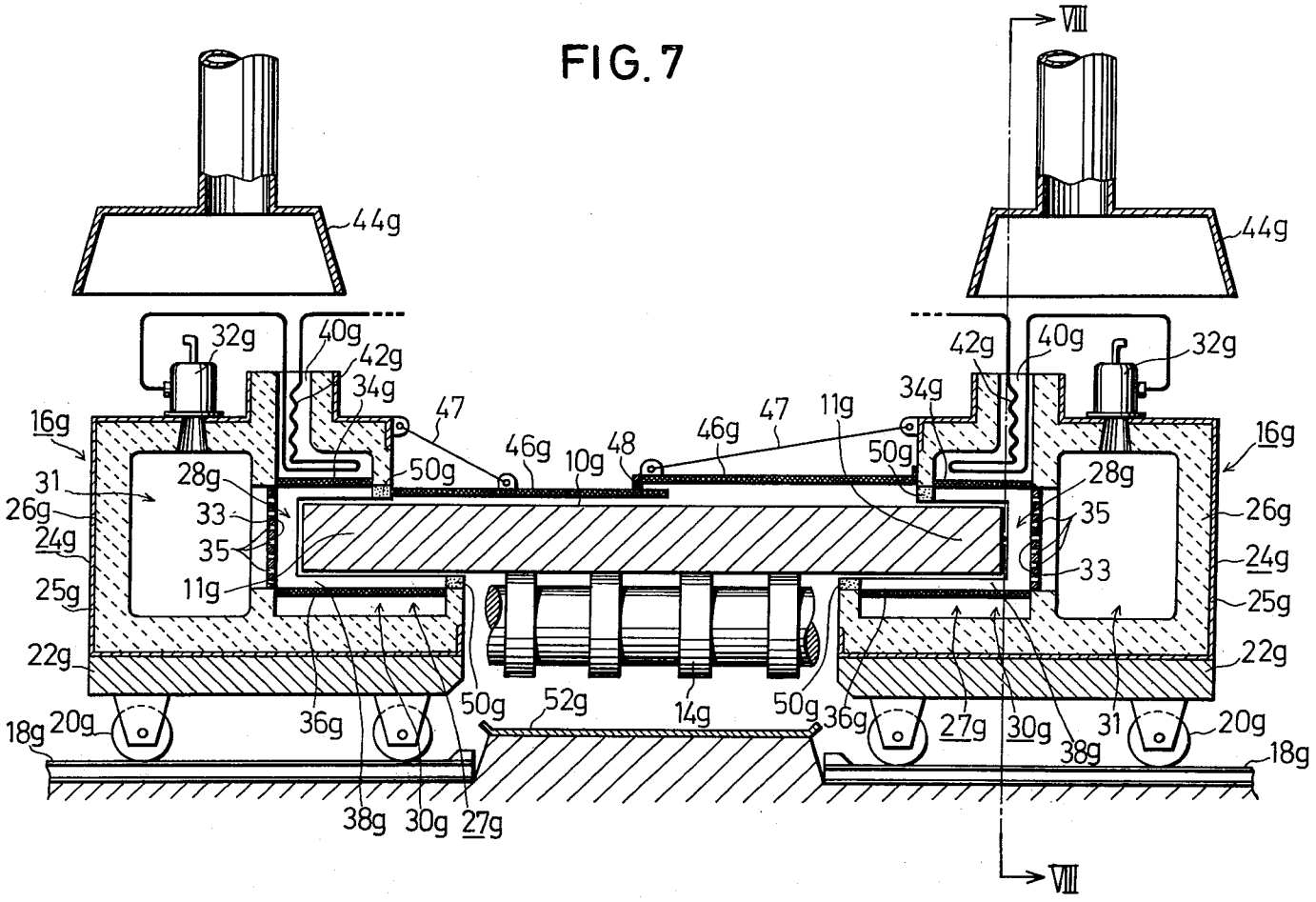
FIG. 7 is a sectional view of a heater system similar to, but different from that of FIG. 1 in that a heater block includes a dispersion plate.
Figure 8:
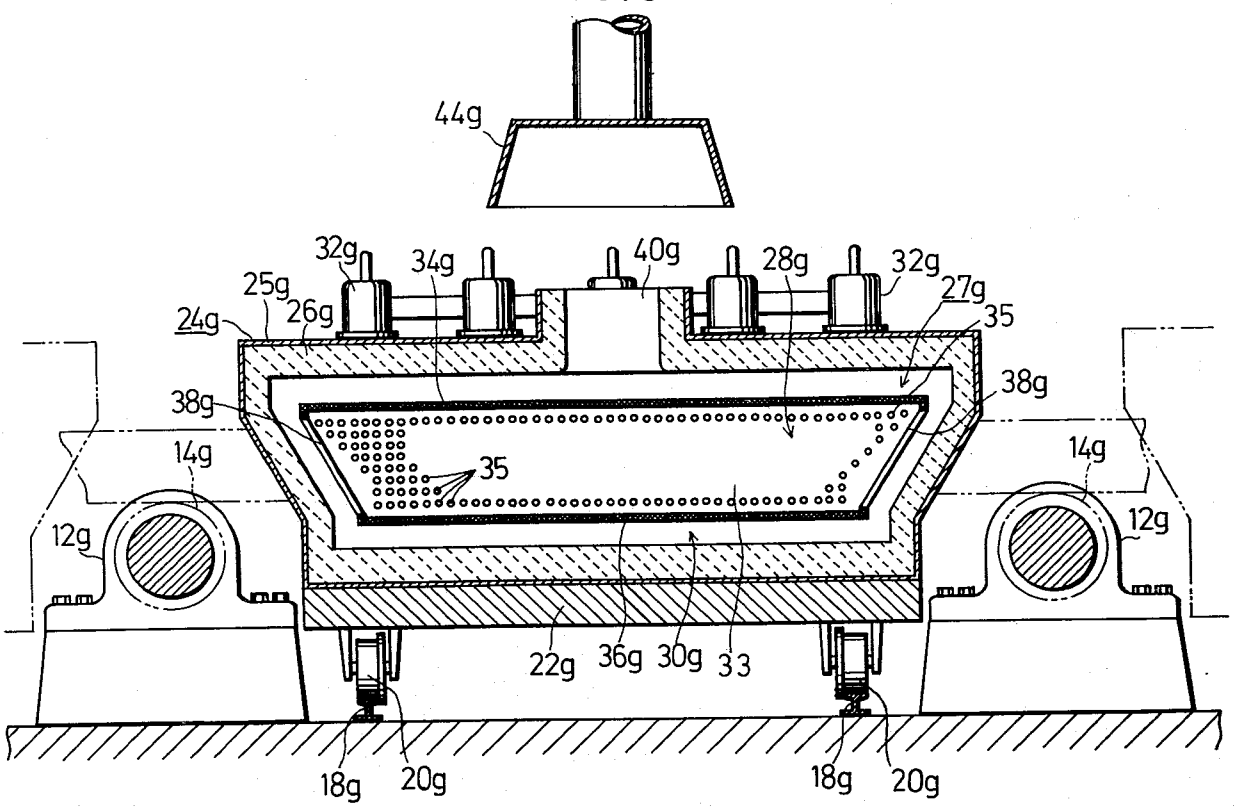
FIG. 8 is a cross section of the system of FIG. 7 taken on the line VIII—VIII of FIG. 7.

Yet another construction of heater block is illustrated in FIGS. 7 and 8. In this construction 16g, a block casing 24g includes a combustion chamber 31 which is allowed to communicate with a heating chamber 28g by a heat-resistant dispersion plate 33 located between the two chambers, but having a number of air holes 35 therethrough so as to allow the combustion gases to come from the chamber 31 into the other chamber 28g.

In the foregoing construction, flames are produced from a burner 32g, and burned in the combustion chamber 31 to produce combustion gases. Then the gases enter the heating chamber 28g in a uniformly-dispersed condition by passing through the plate 33. When thus flowing into the chamber 28g, the gases are given a slightly smaller velocity by the presence of the intermediate plate 33. Supplied into the chamber 28g, the gases heat one of the broadwise-end portions 11g of a metal material 10g. Numeral 47 of FIG. 7 designates a wire to support cover plates 46g.

Figure 9:
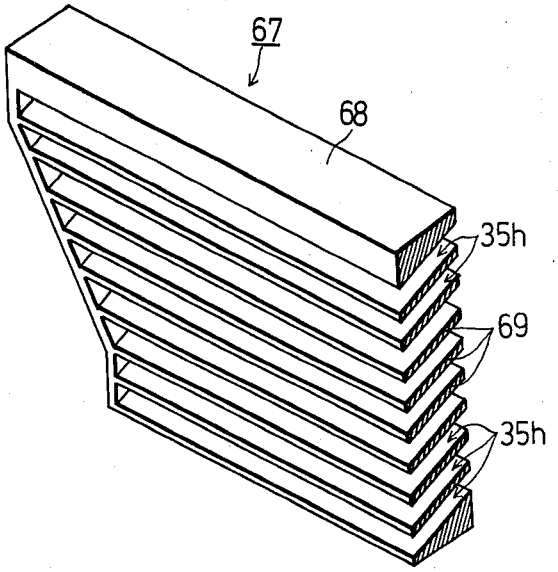
FIG. 9 is a partly-broken perspective view of a dispersion plate which may take the place of that of FIG. 7.

The dispersion plate 33 of FIGS. 7 and 8 may be replaced by that 67 of FIG. 9. This dispersion plate 67 is of a louvershaped construction having a framework 68 and a plurality of plates 69 connected to and inside the framework 68 in inclined positions and spaced apart from one another so as to provide gas passages 35h.

Figure 10:
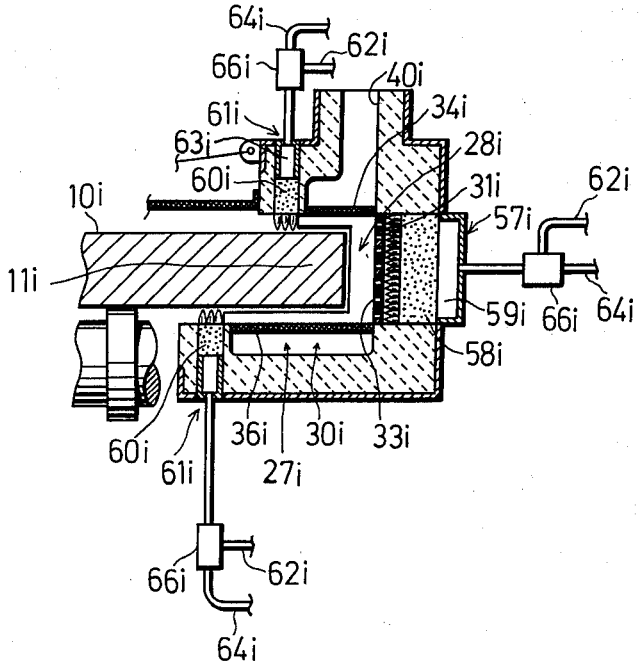
FIG. 10 is a sectional view of a heater block for the system of FIG. 7 which is different from that of FIG. 7 in that burning walls are employed as burners and sealer means.

The constructions of FIGS. 6 and 7 may be combined to produce such a construction of heater block 16i as shown in FIG. 10.

Figure 11:
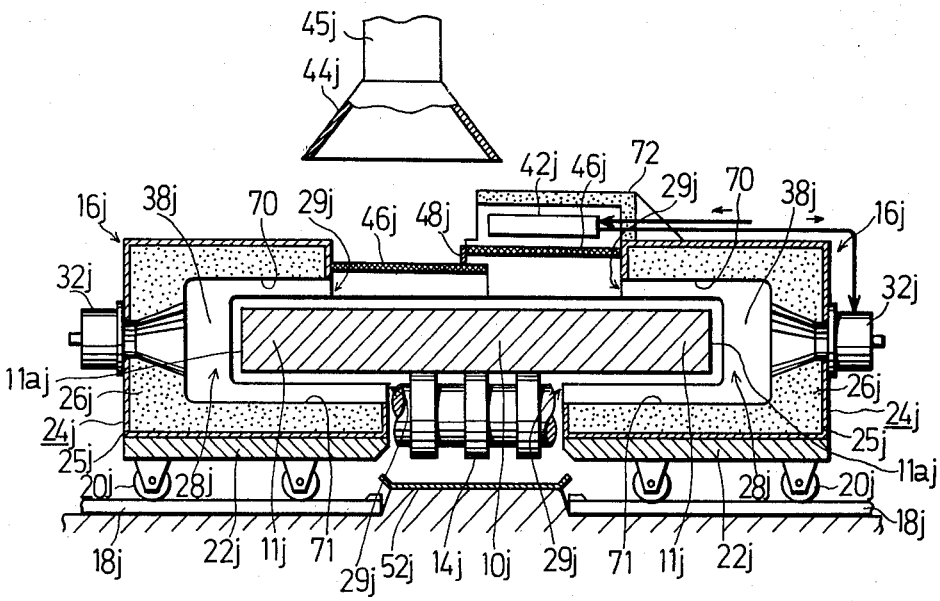
FIG. 11 is a sectional view of a heater system including heater blocks different from the preceding ones.

Yet another construction of heater block is illustrated in FIG. 11. In a casing 24j of this construction 16j, the lower surface 70 of its top and the upper surface 71 of its bottom act as means for allowing hot combustion gases to flow along the upper surface 11bj and lower surface 11cj of one of the broadwise-end portions 11j of a metal material; that is, the surfaces 70 and 71 correspond to the top 34 and bottom 36 of the first construction in function.

In the foregoing construction, hot gases blown from a burner 32j into a heating chamber 28j first heat one of the lengthwise sides 11aj of the material 10j as in the preceding constructions. Then, the gases are divided into an upper stream and a lower stream, and each stream of the gases is guided toward an inner opening 29j of the casing 24j by means of the lower surface 70 of the casing top or the upper surface 71 thereof while heating the upper surface 11bj or lower surface 11cj of the broawise-end portion 11j of the material. When thus flowing along the surfaces of the material, the gases also heat the top and bottom of the casing 24j so that the top and bottom of the casing radiate heat against the upper surface 11bj and lower surface 11cj of the broadwise-end portion 11j of the material, respectively. After thus heating the material 10j, the upper stream of the gases comes from the inner opening 29j of the casing 24j and passes a cover plate 46j of air-permeable solid matter to flow upward while a certain amount of heat of the gases is transferred to the cover plate 46j when the gases pass the plate 46j, thus increasing the temperature of the same plate. Then the plate 46j in turn radiates the great amount of heat against the material. A portion of the gases having passed the cover plate 46j is allowed to enter a space covered with an enclosure 72 of adiabatic material and heat a heat exchanger 42j located therein. Then those gases, as well as the other portion of them having passed the plate 46j, are collected by a hood 44j. Also, after having heated the material, the lower stream of the gases comes from the inner opening 29j of the casing 24j, and a portion of thereof flows downward so that the outside air of lower temperature may be prevented from entering the space between the material 10j and the heater block 16j.

A metal material of the same dimensions and temperature distribution as that of FIG. 4 has been treated by using the system of FIG. 11 as follows: The material was conveyed through the system at a rate of two meters per minute while burning fuel at a rate of 500,000 kcal./hr. for each length of material of one meter to heat the broadwise-end portions of the material. The result obtained after the treatment for two minutes is that the temperatures $T_a$, $T_b$, $T_c$, and $T_d$ are 1,160° C., 1,130° C., 1,140° C., and 1,310° C., respectively. That is, the material has obtained a distribution of the temperature suitable for the hot rolling thereof.

Figure 12:
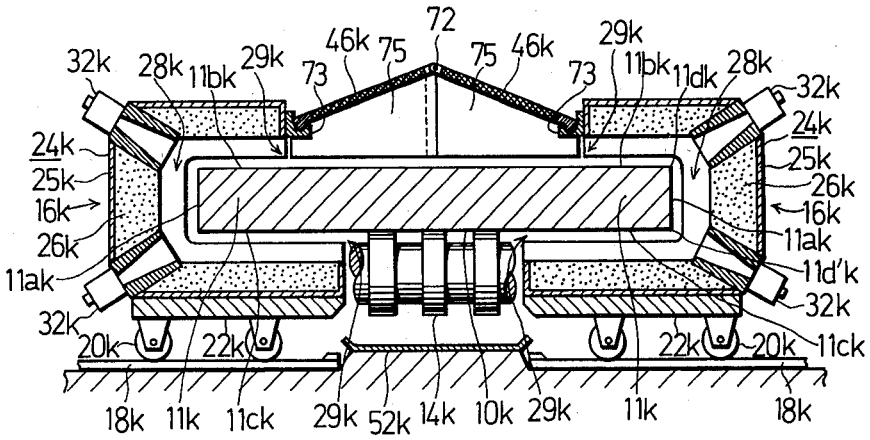
FIG. 12 also is a sectional view of a heater system including heater blocks different from the preceding ones.

The heating system of FIG. 11 may be modified by changing both number and locations of the burners and construction of the cover plates as shown in FIG. 12. That is, in the construction of FIG. 12, burners 32k are all directed to the upper edge 11dk or lower edge 11dk' of a metal material 10k extending along the length of the material. Also, a pair of cover plates 46k are pivotally connected to each other by means of a hinge 72 while each plate 46k is rotatably supported, at its outward end, by a groove provided in a carrier means 73 which is connected to a heater block 16k. Numeral 75 designates a side plate connected to one side of each cover plate 46k. Although not shown in FIG. 12, a corresponding side plate is also connected to the opposite side of the plate 46k.

As many apparently widely different embodiments of this invention may be made without departing from the spirit and scope thereof, it is to be understood that the invention is not limited to the specific embodiments thereof except as defined in the appended claims.

What is claimed is:

1. A system for heating the broadwise-end portions of metal plate which comprises (a) a means for conveying a metal material and (b) a pair of heater blocks spaced apart from each other with a predetermined line of conveyance for the metal material extending therebetween and each adapted to heat one of the broadwise-end portions of the material and is characterized in that each said heater block includes:

(i) a casing which is provided with a space to receive said broadwise-end portion of the material and an opening to allow said broadwise-end portion of the material to enter said space and is located in such a position as allows said broadwise-end portion of the material to pass through said space when the material is conveyed along said conveyance line;

(ii) a burner connected to said casing for blowing high-temperature gases against the broadwise-end surface of said broadwise-end portion of the material;

(iii) a horizontal partition means disposed directly above the upper surface of said broadwise-end portion of the material in conveyance so as to allow a portion of said high-temperature gases blown against said broadwise-end surface of the material to flow along said upper surface of broadwise-end portion of the material; and (iv) a horizontal partition means disposed directly below the lower surface of said broadwise-end portion of the material in conveyance so as to allow the other portion of said high-temperature gases blown against said broadwise-end surface of the material to flow along said lower surface of broadwise-end portion of the material.

2. A system of claim 1 wherein said upper and lower partition means both are made of air-permeable solid matter and said casing further includes a flow passage located on the upper side of said upper partition means so as to allow said upper stream of gases having passed said upper partition means to come from said heater block and also has a flow passage located on the lower side of said lower partition means so as to allow said lower stream of gases having passed said lower partition means to come from said heater block.

3. A system of claim 2 wherein said each heater block further includes a truck movable in the broadwise direction of the metal material in conveyance and said casing of heater block is connected to the top of said truck.

4. A system of claim 3 further including a pair of cover means which are disposed between said heater blocks and vertically spaced apart from the middle portion of the metal material in conveyance not received by said heater blocks so as to provide a thermal insulation between said middle portion of metal material in conveyance and the outside air.

5. A system of claim 4 further including a heat exchanger located in said upper flow passage so as to preheat air to be supplied to said burner.

6. A system according to anyone of the preceding claims 1 to 5 wherein said burner is a jet burner faced toward said broadwise-end surface of the metal material in conveyance so as to blow high-temperature gases against said broadwise-end surface of the material and a means for separating said high-temperature gases blown from said burner into an upward stream and downward stream is provided between the metal material in conveyance and said burner and in close proximity to said broadwise-end surface of the metal material in conveyance.

7. A system according to anyone of the preceding claims 1 to 5 wherein said casing further includes a combustion chamber communicating with said receiver space with a dispersion plate located therebetween and including a number of air holes in the entire body thereof and said burner is located in such a position as allows said burner to supply high-temperature gases into said combustion chamber.

* * * * *